United States Patent [19]

Torres

[11] Patent Number: 4,614,288

[45] Date of Patent: Sep. 30, 1986

[54] APPARATUS FOR LOCKING A MECHANICAL DEVICE OUT OF ENTRAINMENT

[75] Inventor: Jean Torres, Lausanne, Switzerland

[73] Assignee: Societe Anonyme de Plieuses Automatiques, Ecublns, Switzerland

[21] Appl. No.: 696,453

[22] Filed: Jan. 31, 1985

[30] Foreign Application Priority Data

Feb. 6, 1984 [CH] Switzerland ..... 545/84

[51] Int. Cl.[4] ..... B65H 20/16

[52] U.S. Cl. ..... 226/165; 74/43; 74/144; 74/470

[58] Field of Search ..... 226/100, 124, 139, 165; 74/144–148, 43, 470

[56] References Cited

U.S. PATENT DOCUMENTS

| | | | |
|---|---|---|---|
| 2,308,348 | 1/1943 | Ballash | 226/100 |
| 2,755,915 | 7/1956 | Fox | 226/165 X |
| 3,172,297 | 3/1965 | Thiene | 74/148 |
| 3,203,608 | 8/1965 | Mogolis | 226/124 |

*Primary Examiner*—John M. Jillions

*Attorney, Agent, or Firm*—Hayes, Davis & Soloway

[57] ABSTRACT

This actuating and locking apparatus comprises an actuating shaft (1) mounted in two bearings (2) and (3) and on which is mounted a control lever (6), a second lever (25), a spring (15), a part (20) rigidly connected to the shaft (1) and an arm (45) rigidly connected to this shaft and bearing a small plate (43) intended to co-act with an electromagnet (41). The control lever (6) is mounted freely on the actuating shaft (1), while the second lever (25) is rigidly connected to this shaft. In normal operation a connecting rod (14) causes the control lever (6) to pivot around its axis, thus driving via the lateral pin (23) and the recess (24) the second lever (25) and consequently the shaft (1). In order to lock e.g. a paper gripper (36), the electromagnet (41) is excited, thus locking the small plate (43), the actuating shaft (1) and the lever (25) in the upper position, allowing free displacement of the control lever (6) and generating torsion on the spring (15) during each cycle.

5 Claims, 2 Drawing Figures

APPARATUS FOR LOCKING A MECHANICAL DEVICE OUT OF ENTRAINMENT

The present invention relates to an apparatus for actuating and locking a mechanical member particularly a paper gripper in a packaging machine, comprising a rotary actuating mechanism, a connecting rod for converting rotary movement into a reciprocating pivoting movement and an actuating mechanism for transmitting this reciprocating pivoting movement to the mechanical device.

Known apparatus of this type normally comprises an open cam which is driven by the rotary mechanism and on which there rests a follower roller linked to a connecting rod designed to convert the rotary movement into a reciprocating pivoting movement and which drives a reciprocating actuating mechanism connected to the mechanical member. To lock the mechanical device without stopping the rotary mechanism, there is normally a mechanical or pneumatic locking element which locks the follower roller in a position wherein it is not resting on the cam.

Such locking devices have the disadvantage that they have a relatively long reaction time, which results in a limitation of the operating rhythm of packaging machines which are equipped with them. Moreover, their construction is often complex and therefore costly.

The present invention proposes to remedy this drawback by providing apparatus like that mentioned above in which the stopping of the mechanical device may be accomplished extremely rapidly, thus enabling the operating rhythm of machines equipped with this mechanical device to be increased significantly.

To this end, the apparatus according to the invention is characterised in that it comprises a first control lever fixed to the rotary actuating mechanism, a second lever connected to the reciprocating actuating mechanism, and an electromagnet adapted to allow, in a first position, the coupling of the two levers, and in a second position, the locking of the second lever without interrupting the reciprocating movement of the control lever.

Figure 1:
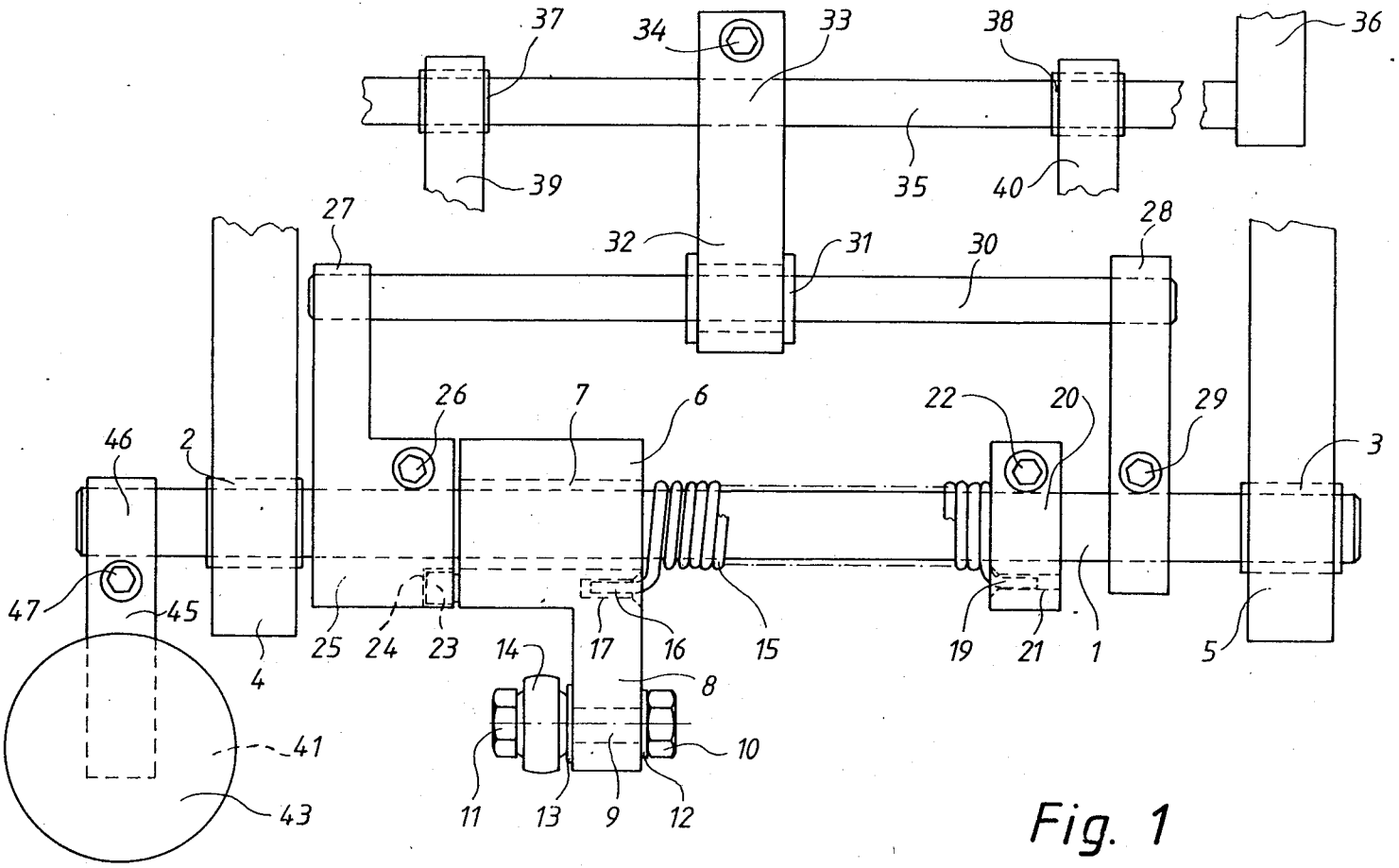
Figure 2:
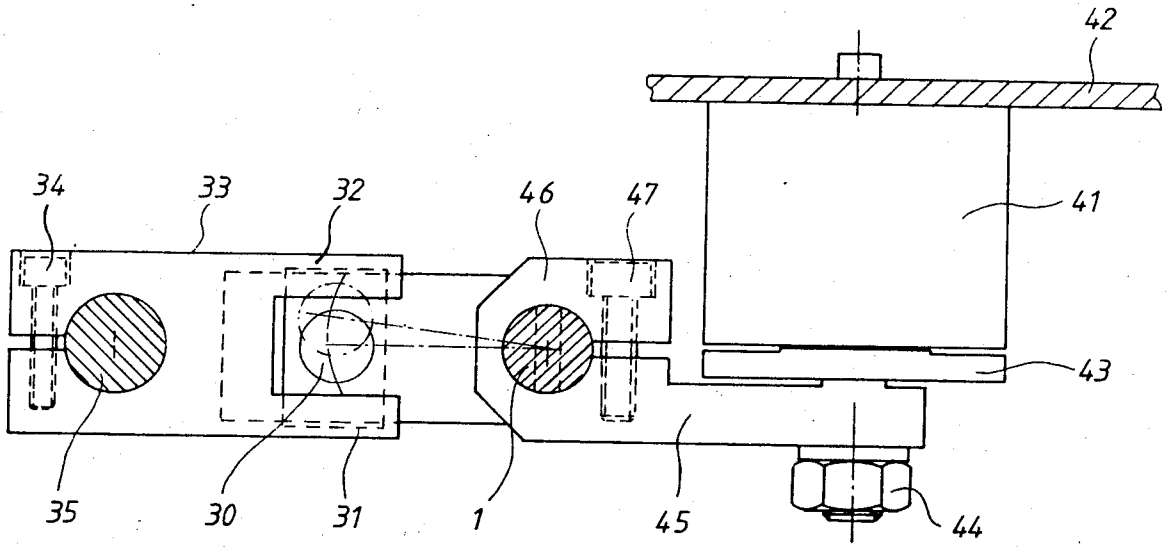

The present invention and its main advantages will be better understood with reference to the description of an embodiment example and the attached drawing, on which:

FIG. 1 is a schematic view from above onto the apparatus according to the invention, and FIG. 2 is a partial elevation view of the apparatus shown in FIG. 1.

With reference to the Figures, the apparatus described, has the function of alternately actuating a mechanical member such as a paper gripper in a packaging machine, for example, and of stopping the movement of this member temporarily without simultaneously stopping the entire machine. For this purpose, the apparatus shown comprises essentially an actuating shaft 1 which is mounted horizontally in two bearings 2 and 3 which are mounted respectively on two cross-members 4 and 5 rigidly attached to the frame of the machine. This shaft 1 bears a control lever 6 provided with an axial bore in which a bushing 7 is accommodated, through which this shaft passes. The said control lever 6 is thus mounted freely on the shaft 1. In extension of the control lever 6 there is an arm 8 through which there is a bore extending parallel with the shaft 1 and in which a rod 9 is accommodated, being held in position by nuts 10 and 11 and washers 12 and 13, and serving as a support for one of the ends of a connecting rod 14, the other end of which is, for example, rigidly connected to an eccentric device (not shown) which is driven for rotation around an axis parallel with the rod 9. As a result, the rod 14 attached to the arm 8 drives the control lever 6 in a pivoting movement around the shaft 1.

A spring 15 which extends coaxially with the shaft 1 is connected by one of its ends 16 aligned parallel with this shaft 1 to the control lever 6 which is provided for this purpose with a hole 17 in which this end is engaged, and by its other end 19, again aligned parallel with the shaft 1, to a part 20 which is provided for this purpose with a hole 21 in which the said end 19 is engaged. The part 20 is rigidly connected to the shaft 1 by means of a bolt 22 or any other suitable device such as a keeper pin or the like. In addition, the control lever 6 is equipped with a lateral pin 23, the upper surface of which is complementary to the side surface of a recess 24 formed in a second lever 25 adjacent to the control lever 6, which is also mounted on the shaft 1 and which is rigidly connected to this shaft by means of a bolt 26, keeper pin or any other suitable device. The second lever 25 is provided with a projection 27 which acts as a support, jointly with an arm 28 rigidly connected to the shaft 1 by a bolt 29, for an axle 30 disposed parallel with the entrainment shaft 1.

In normal operation the connecting rod 14, actuated in a reciprocating movement and acting on the arm 8, causes the control lever 6 to pivot around the shaft 1 alternately towards the top and towards the bottom. The lateral pin 23, the upper surface of which is pressed tightly against the opposite surface of the recess 24 due to a certain amount of pre-stressing of the spring 15 urging the shaft into its position corresponding to the lower position of the arm 8, entrains the second lever 25 connected to the shaft 1 in its movement, which results in the pivoting of the axle 30, which in its movement describes a cylindrical sector centered on the axis of the shaft 1. A sliding component 31, which is capable of sliding axially along the axle 30, is connected to an arm 32, the end 33 of which is fixed by a bolt 34 to a shaft 35, the function of which consists, for example, of controlling a gripper 36 shown schematically in FIG. 1. The shaft 35 parallel with the axle 30 is mounted, for example, in two bushings 37 and 38 which allow this shaft to slide axially, and which are mounted on two fixed supports 39 and 40 rigidly connected to the frame of the machine. In normal operation, the pivoting movement of the axle 30 is transmitted via the arm 32 to the shaft 35, which pivots around its axis, thus generating the desired pivoting movement for the gripper 36.

During normal operation the spring 15 acts as a rigid coupling device, but is not subjected to any additional torsion since the lever 6 and the part 20 to which the two ends of this spring are connected are subjected simultaneously to the same reciprocating rotary movement around the shaft.

In order to stop the movement of the gripper 36 without simultaneously locking the connecting rod 14 the apparatus is equipped with an electromagnet 41 mounted on a support 42 which is rigidly connected to the frame of the machine, and having a small circular plate 43 which is intended to cling to the electromagnet when the latter is excited. The small plate 43 is fixed by a bolt 44 (see FIG. 2) to an arm 45 which is rigidly connected to the shaft 1 via a clip 46 which can be drawn tight by means of a screw 47. When the electromagnet 41 is excited, the small plate 43 is drawn against its lower face so that the small plate is held in its upper position. Since it is connected via the arm 45 to the shaft 1 and since the second lever 25 is also rigidly connected to this shaft, the latter is held in an upper position in which the recess 24 provides sufficient space to allow the lateral pin 23 to carry out is reciprocating movement provided by the connecting rod 14 without interfering with the upper surface of this recess. In this case, all the elements rigidly connected to the shaft 1 are held in a stationary position, particularly the paper gripper 36. Since the end 16 of the spring 15 is subjected to the same pivoting movement as the control lever 6 and the other end 19 of this spring is held in a stationary position as it is connected to the part 20 which is itself rigidly connected to the shaft 1, the spring is subjected on each cycle to alternating torsion linked to the amplitude of the pivoting movement of the control lever 6.

With this apparatus, the stopping of the gripper 36 can be effected virtually instantaneously the moment the electromagnet 41 is excited. While it is stopped only a reduced number of parts continue to move. During normal operation, the spring 15 is subjected only to its initial pre-stressing, which ensures that it has a long working life. The re-engagement of the actuating mechanism for the gripper 36 can be effected in such a way that contact between the opposing surfaces on the lateral pin 23 and in the complementary recess 24 is made with almost no impact.

Although the apparatus described above and illustrated in the Figures is intended for actuating a paper gripper in a packaging machine, it may be used to control other mechanical devices provided in other processing or handling machines.

I claim:

1. Apparatus for actuating and locking a mechanical member, especially a paper gripper in a packaging machine, comprising:

rotary actuating means;

a connecting rod for converting rotary movement to alternating pivoting movement;

an actuating mechanism for transmitting said alternating pivoting movement to said mechanical member; and means for locking said mechanical member, characterized in that said locking means comprise:

a first lever (6) connected to said connecting rod (14) and coupled with said rotary actuating means (1) by resilient means (15);

a second lever (25) coupled with said rotary actuating means (1) and with said actuating mechanism (30–38);

coupling means (23, 24) associated with said first and second levers for transmitting pivoting movement from said first lever to said second lever in a direction towards a locking position of said second lever; and an electromagnet (41) which locks upon energization said rotary actuating means (1) and said actuating mechanism (30–38) in a position corresponding to said locking position of said second lever (25), so as to thereby lock said mechanical member (36) without interrupting the alternating pivoting movement of said first lever (6).

2. Apparatus according to claim 1, characterized in that:

said rotary actuating means comprises a rotatable shaft (1);

said first and second levers (6, 25) are mounted adjacent to each other on said shaft (1);

said first lever (6) is rotatably mounted on said shaft (1), while said second lever (25) is solidly mounted on said shaft (1).

3. Apparatus according to claim 2, characterized in that said coupling means comprise a lateral projection (23) on one of said levers and, on the other of these two levers, a recess (24) having a side surface which is complementary to said lateral projection, said resilient means comprising a torsion spring (15) having one extremity which is solidly connected with said first lever (6), while the other extremity thereof is solidly connected with said rotatable shaft (1), said spring (15) being prestressed in such a manner as to bring said lateral projection (23) into a position wherein it bears against said side surface of said recess (24).

4. Apparatus according to claim 2, characterized in that said electromagnet (41) comprises a fixed body associated with a movable plate (43) connected solidly with a lever (45) which is rigidly connected to said rotatable shaft (1), and in that said plate is locked by magnetic attraction against said fixed body of the electromagnet when the latter is energized to provide said locking position.

5. Apparatus according to claim 3, characterized in that said first lever (6) is provided with said lateral projection (23) and said second lever (25) is provided with said complementary recess (24).

* * * * *